United States Patent [19]

Lewecke et al.

[11] Patent Number: 4,703,966

[45] Date of Patent: Nov. 3, 1987

[54] VACUUM LIFTING ARRANGEMENT

[75] Inventors: Ernst Lewecke, Lemgo; Manfred Riesenberg, Meinberg, both of Fed. Rep. of Germany

[73] Assignee: Lewecke Maschinenbau GmbH, Blomberg, Fed. Rep. of Germany

[21] Appl. No.: 21,398

[22] Filed: Mar. 4, 1987

[30] Foreign Application Priority Data

Oct. 27, 1986 [DE] Fed. Rep. of Germany ..... 3636523

[51] Int. Cl.[4] ..... B66C 1/02

[52] U.S. Cl. ..... 294/65; 294/64.1

[58] Field of Search ..... 294/65, 64.1, 64.2, 294/64.3; 414/752, 744 B, 737, 627, 172; 271/94, 95, 96, 132; 269/21

[56] References Cited

U.S. PATENT DOCUMENTS 2,128,200 8/1938 Allen ..... 294/64.1

3,910,621 10/1975 Hillier ..... 294/64.1

4,403,567 9/1983 da Costa et al. ..... 269/21

*Primary Examiner*—James B. Marbert

*Attorney, Agent, or Firm*—Erwin S. Teltscher

[57] ABSTRACT

A vacuum lifting arrangement for flat workpieces, such as wooden boards, wooden beams and the like, includes a vertically and horizontally movable housing bounding a suction chamber having a downwardly open suction side. A valve insert is accommodated in the suction chamber and is preferably removably mounted on the housing. A closing plate is hingedly mounted on the housing for pivoting into an out of a closing position in which it sealingly covers the downwardly open suction side of the suction chamber and the valve insert. An elastic sealing element in the form of a foamed mat having suction apertures is mounted on the closing plate, and is operative for sealingly contacting the workpieces to be lifted.

20 Claims, 5 Drawing Figures

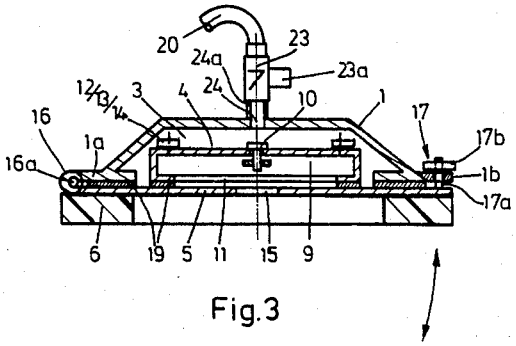
Fig.3
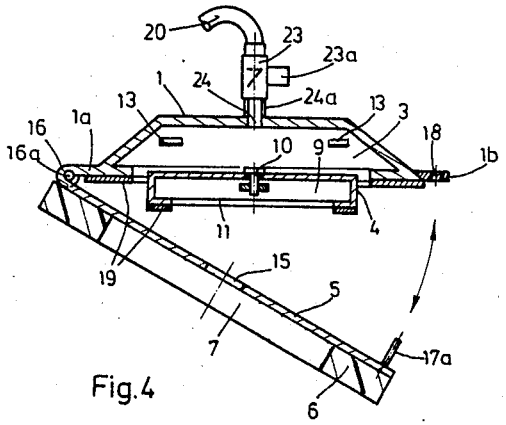
Fig.4
Fig. 5
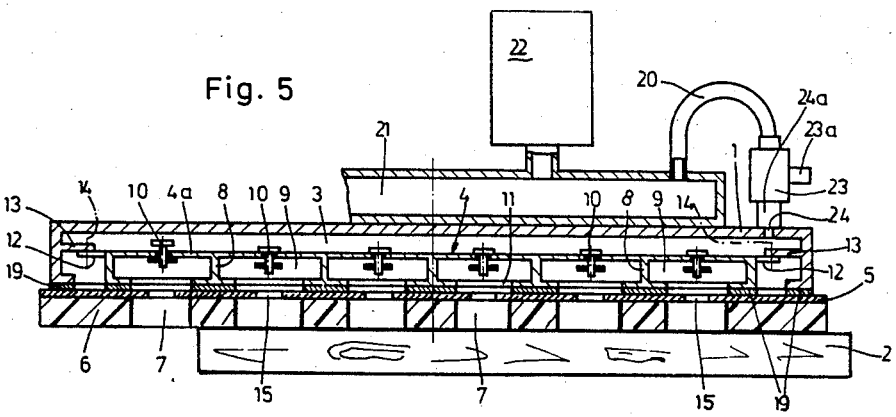

VACUUM LIFTING ARRANGEMENT

BACKGROUND OF THE INVENTION

The present invention relates to transporting arrangements in general, and more particularly to a vacuum lifting arrangement for flat workpieces, such as wooden boards, wooden beams and the like.

There are already known various constructions of vacuum lifting arrangements of the above type, among them such which include a horizontally and vertically movable housing which bounds a suction chamber and an elastic sealing element in the form of a foamed mat which is provided with suction apertures and is arranged on the housing and sealingly contacts the workpieces to be lifted.

Inasmuch as wood chips and dust penetrate during the use of the lifting arrangements of this kind for lifting wooden articles and during the suction operation of such arrangements into the suction chamber, this suction chamber and any components accommodated therein must be cleansed from time to time. However, in the known lifting arrangements of this kind, such a cleansing operation is very cumbersome and time-consuming, since the lifting arrangement, for all intents and purposes, must be disassembled for this purpose.

SUMMARY OF THE INVENTION

Accordingly, it is a general object of the present invention to avoid the disadvantages of the prior art.

More particularly, it is an object of the present invention to provide a vacuum lifting arrangement which does not possess the drawbacks of the known arrangements of this type.

Still another object of the present invention is to devise an arrangement of the type here under consideration which renders it possible to achieve, in a simple and rapid manner, an access to the interior of the housing for cleaning and maintenance purposes.

It is yet another object of the present invention to design the above arrangement in such a manner as to render it possible to gain access to the interior of the housing by using a minimum number of operating steps.

An additional object of the present invention is to develop an arrangement of the above type which renders it possible to achieve a simple and reliable vacuum buildup and an automatic control of the vacuum in the housing for the suction regions which respectively are and are not covered by the workpieces.

It is also an object of the present invention to make even the control arrangement in the housing easily accessible for cleaning and maintenance purposes.

A concomitant object of the present invention is so to construct the arrangement of the above type as to be relatively simple in construction, inexpensive to manufacture, easy to use, and yet reliable in operation.

In keeping with these objects and others which will become apparent hereafter, one feature of the present invention resides in a vacuum lifting arrangement for flat workpieces, such as wood beams and the like, this arrangement comprising a movable housing bounding a suction chamber having a downwardly open suction side; a valve insert accommodated in the suction chamber; a closing plate hingedly mounted on the housing for pivoting into and out of a closing position in which it sealingly covers the downwardly open suction side of the suction chamber and the valve insert; and an elastic sealing element in the form of a foamed mat having suction apertures, mounted on the closing plate, and operative for sealingly contacting the workpieces to be lifted.

Advantageously, the housing has a hood-shaped configuration having an elongated rectangular basic shape and a trapezoidal cross section having a large base side situated downwardly and being open, and the base side is closed by the closing plate and the elastic sealing element mounted thereon. The housing has two marginal flanges and the closing plate has two longitudinal edge portions, and there is advantageously further provided hinge means for pivotally mounting one of the longitudinal edge portions on one of the marginal flanges, and at least two connecting means for releasably connecting the other of the longitudinal edge portions under tension to the other of the marginal flanges. It is particularly advantageous when each of the connecting means includes one of threaded connecting means, buckle connecting means, and bayonet connecting means. When the connecting means is constructed as threaded connecting means, then it may include a threaded bolt pivotally mounted on the closing plate and passing through a bore-shaped or a slot-shaped opening of the other marginal flanges in a connecting position thereof, and a threaded hand nut threaded onto the threaded bolt and operative for arresting the same in the connecting position thereof.

According to a currently preferred aspect of the present invention, the hinge means includes at least one rod hinge. The hinge means advantageously includes a hinge axle extending in the longitudinal direction of the housing and extractable from the remainder of the hinge means for removal of the closing plate with the sealing element from the housing.

The vacuum lifting arrangement advantageously further comprises circumferentially extending sealing means secured to the lower sides of the housing and of the valve insert and sealingly engaged under tension by the closing plate. It is further advantageous when the valve insert includes a hollow casing extending over the entire length of the housing and including internal partitioning walls that subdivide the interior of the casing into a plurality of individual chambers, and a plurality of valves, such as tappet valves, dish valves, ball valves, jet nozzles and the like, each arranged in one of the individual chambers. Each of these valves is mounted in an upper wall of the valve insert for vertical movement, and each of the individual chambers opens at a lower region thereof onto the closing plate by a large-area opening.

According to another facet of the present invention, the valve insert is removably mounted in the housing. To this end, the valve insert has two oppositely situated sides and includes at least two outwardly extending connecting lugs at each of the sides thereof, and the housing includes inwardly extending connecting webs, and there are further provided connecting screws which extend through the connecting lugs and the connecting webs and serve for releasably mounting the valve insert in the housing.

The valve insert is accommodated in the suction chamber with a clearance at all sides from the housing; and there is further provided a vacuum accumulator, means including a three-way valve and a hose conduit for connecting the vacuum accumulator with the suction chamber, and a vacuum pump connected to the vacuum accumulator. The housing advantageously includes a nipple which is arranged at one longitudinal end of the housing and bounds a suction opening; and the three-way valve is accommodated in the suction opening and is switchable between a suction position and an aerating position thereof.

According to another advantageous concept of the present invention, the lifting arrangement further comprises a plurality of additional housings, valve inserts, closing plates and sealing elements similar to the housing, valve insert, closing plate and sealing element, respectively and a vacuum accumulator, and all of the housings are mounted underneath the vacuum accumulator for individual stepless vertical and horizontal movement and for arresting in position to form a vacuum lifting installation which is adjustable with respect to the distribution of suction openings. The vacuum accumulator advantageously is configured as a housing or frame which is closed at all sides and holds all of the housings on respective guides. Last but not least, the valve insert includes a hollow casing extending over the entire length of the housing and including internal partitioning walls that subdivide the interior of the casing into a plurality of individual chambers, and a plurality of valves each arranged in one of the individual chambers, and the closing plate is provided with a suction opening at the region of each of the individual chambers of the valve insert, and the sealing element is provided at the region of each of the suction openings with a suction aperture having an elongated slot-shaped configuration extending transversely to the longitudinal direction of the housing.

The lifting arrangement constructed in the above-discussed manner has the following advantages:

1. The pivotable closing plate renders it possible to obtain, by using only a small number of handling operations, an easy access to the interior of the housing for the cleaning of the suction chamber and of the valve insert.
2. It is possible to remove the valve insert, by using only a few simple handling operations, from the housing for cleaning and maintenance purposes as well as for the replacement of the valves.
3. The sealing element which is constituted by the foamed mat and which is mounted on the closing plate can be easily and quickly renewed due the the pivotability or the removability of the closing plate.
4. The three-way valve, together with the vacuum accumulator and the suction chamber, as well as with the valve insert, provides for an optimum vacuum buildup and an automatic control of the suction apertures which are respectively juxtaposed and not juxtaposed with the workpieces to be lifted, thus assuring a high suction force.
5. A plurality of such vacuum lifting arrangements can be arranged underneath a common vacuum accumulator for mutual stepless horizontal and vertical movement and arresting in position, as a result of which there is provided a lifting installation having individually adjustable suction apertures, which solves a further objective of an optimized suction aperture distribution for the various and differently dimensioned and oriented workpieces.

BRIEF DESCRIPTION OF THE DRAWING

The present invention will be described below in more detail with reference to the accompanying drawing in which:

FIG. 3 is a cross-sectional view of a vacuum lifting arrangement of the present invention which includes a valve insert accommodated in a hood-shaped housing and a closing plate pivotally mounted on the housing and carrying a sealing element, with the closing plate being in its closing position;

FIG. 4 is a view similar to FIG. 3 but with the closing plate in its open position and with the valve insert being partially removed from the interior of the housing; and FIG. 5 is a longitudinal sectional view of the vacuum lifting arrangement of FIG. 3.

DETAILED DESCRIPTION OF THE PREFERRED EMBODIMENT

Figure 1:
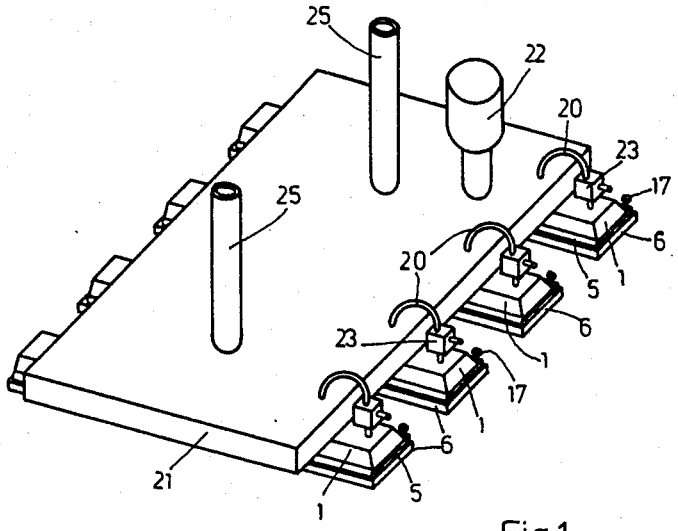
FIG. 1 is a perspective view of a vacuum lifting installation according to the present invention, including a plurality of lifting arrangements adjustably mounted underneath a common vacuum accumulator.

Referring now to the drawing in detail, and first to FIG. 1 thereof, it may be seen that the reference numeral 1 has been used therein to identify a hood-shaped housing of a vacuum lifting apparatus for the lifting and transporting of flat workpieces 2, such as wooden boards, wooden beams or the like. The housing 1 has an elongated rectangular basic shape and a trapezoidal cross section. This housing 1 forms a suction chamber 3 and receives a removable valve insert 4 in this suction chamber 3.

The suction chamber 3 and the valve insert 4 are covered at the housing side, which is located below and is open and which constitutes the suction side, by a closing plate 5 which is mounted on the housing 1 for pivoting away from the latter. An elastic sealing element 6 in the form of a foam mat provided with a plurality of suction apertures 7 is connected underneath this closing plate 5. The sealing element 6 conformingly contacts the respective workpieces 2 for lifting and transporting the same. The closing plate 5 and the sealing element 6 together constitute a suction plate.

The valve insert 4 is constituted by a casing (hollow plate) having a rectangular basic shape and a rectangular cross section. The hollow space of the valve insert 4 is subdivided by a plurality of partitioning walls 8 extending transversely to the longitudinal direction of the insert 4 into a plurality of individual chambers 9. A valve in the form of a tappet valve, dish valve, ball valve or a jet opening is situated in each of the individual chambers 9. As shown particularly in FIG. 5 of the drawing, the valves 10 are mounted in a closed top wall **4*a* of the valve insert 4. The top wall 4*a* provides for a separation between the suction chamber 3 and the individual chambers 9. In the closed condition of the valves, there is provided a suction connection between the suction chamber 3 and the individual chambers 9**, and this connection is interrupted in the closed valve condition.

The lower side of the valve insert 4 is opened at the region of each of the individual chambers 9 by a large opening 11. Each of these openings 11 takes up almost the entire area of the respective individual chamber 9 and, in correspondence with the shape of the respective individual chamber, has a square or a rectangular basic shape.

The valve insert 4 extends over almost the entire length and width of the housing 1 and is held therein in such a manner that it can be removed therefrom. This holding action takes place at a plurality of zones which are situated at the mutually opposite longitudinal and transverse sides of the housing 1, for instance, at four connecting zones. To achieve this holding action, connecting lugs 12 are provided at the exterior of the valve insert 4, and the housing 1 is provided at its inner side with connecting webs 13. The valve insert 4 is introduced into the housing 1 through the downwardly open housing side and the connecting lugs 12 of the valve insert 4 come to lie below the connecting webs 13. The releasable connection between the connecting lugs 12 and the connecting webs 13 is then accomplished by means of screws 14. The valve insert 4 then extends into the suction chamber 3 with a clearance at all sides from the housing 1 in such a manner that it is flush at its lower side with the lower side of the housing 1.

The closing plate 5 is provided at the region of each of the individual chambers 9 of the valve insert 4 with a suction bore 15. One of the suction apertures 7 is arranged at the region of each of the suction bores 15. In a currently preferred manner, each of the suction apertures 7 is constituted by an elongated slot-shaped opening which extends transversely to the longitudinal direction of the housing 1 and thus of the sealing element 6, so that the sealing element 6 is provided with a number of the suction apertures 7 which depends on the number of the individual chambers 9.

The closing plate 5 is pivotally mounted at one of its longitudinal edges by a hinge 16, preferably a rod hinge, to one of lateral marginal flanges 1*a* of the housing 1, as shown in FIGS. 3 and 4 of the drawing. The arresting of the closing plate 5 in its upwardly pivoted position of use is accomplished by means of a plurality of manually operable closing arrangements 17 in the form of screw connectors, buckle connectors, bayonet connectors or the like. Preferably, at least two threaded bolts 17*a* are pivotally mounted on the closing plate 5 at a distance from one another in the longitudinal direction of the closing plate 5. Each of these threaded bolts 17*a* passes through a respective bore 18 or a fork-like recess in another marginal flange 1*b* of the housing 1 and is tensioned against the other marginal flange 1*b* by a respective nut 17*b*, preferably a knurled nut or a wing nut which is threaded thereonto.

The housing 1 is equipped underneath the marginal flanges 1*a* and 1*b* with a circumferentially extending seal 19, and a seal 19 is also arranged at the lower side about the openings 11 of the valve insert 4. The closing plate 5 is sealingly pressed against the seal 19 by the closing arrangements 17.

For the cleaning of the valve insert 4 and also of the suction chamber 3 by means of pressurized air, the closing arrangements 17 are released and then the closing plate 5 together with the sealing element 6, is pivoted downwardly, so that there is provided a good access to the interior of the lifting apparatus.

By releasing the screws 14, it is possible to remove the valve insert 4 downwardly out of the housing 1 for the replacement of the valves 10 or for other service or maintenance work.

FIG. 4 of the drawing shows the closing plate 5 in its downwardly pivoted position, and the valve insert 4 in its partially removed position. It is also possible to remove the closing plate 5 from the housing 1, in that a hinge axle 16*a* is pulled out of the hinge 16. This is advantageous when a new sealing element 6 is to be mounted on the closing plate 5. This replacement of the sealing element 6 is rendered necessary from time to time by wear of the sealing element 6.

The suction chamber 3 is in communication, via a flexible hose connection 20, with a vacuum accumulator 21. The vacuum accumulator 21 is constituted by a housing which is closed on all sides (see FIGS. 1 and 5), or by a frame which is closed on all sides (see FIG. 2). The vacuum accumulator 21 is in communication, either directly or via a hose conduit, with a vacuum source 22, preferably a vacuum pump. The vacuum pump 22 can also be mounted on the vacuum accumulator 21.

A three-way valve 23 is interposed in the hose conduit 20 between the vacuum accumulator 21 and the suction chamber 3. The valve 23, in its connecting position, establishes a suction connection between the vacuum accumulator 21 and the suction chamber 3 and, in its closing position, causes aeration of the suction chamber 3 in order to eliminate the vacuum. This aeration is achieved by the admission of air from the ambient atmosphere through one or more aerating nozzles 23*a* provided on the valve 23.

The housing 1 is provided at its top wall with a nipple 24*a* which forms a suction opening 24 to the suction chamber 3 and simultaneously accommodates the three-way valve 23.

Having so described the construction of the lifting apparatus according to the present invention, its operation will now be explained in some detail, still with reference to the drawing:

The vacuum pump 22 produces a vacuum in the vacuum accumulator 21, while the three-way valve 23 interrupts the connection between the vacuum accumulator 21 and the suction chamber 3, so that it is in its aerating position. The lifting apparatus is lowered toward and onto the workpiece 2 to be lifted. During this lowering operation, the elastic sealing element 6 becomes well fitted to and establishes a sealed contact with the upper surface of the workpiece 2. Subsequently, the three-way valve 23 is opened, that is, switched in such a manner that a connection is established through the hose conduit 20 between the vacuum accumulator 21 and the suction chamber 3, and the aerating nozzle or nozzles 23*a* is or are closed.

Thereafter, a vacuum and thus a suction force is established in the suction chamber 3 through the suction opening 24 provided in the housing 1 and through the valves 10 also in the individual chambers 9. The workpiece 2 is firmly attracted to the sealing element 6 due to this vacuum or suction force, and can then be lifted.

At that region of the suction apertures 7 at which a workpiece 2 or a part of a workpiece 2 is located, the valves 10 remain in their open positions and a suction effect is exerted on the workpiece 2. On the other hand, at that region of the suction apertures 7 at which no workpiece 2 is present or where the workpiece 2 has cracks, the valves 10 are moved by the suction effect upwardly into their closed positions, so that the corresponding individual chambers 9 are closed and no further suction force is exerted on these chambers 9 by the vacuum prevailing in the suction chamber 3.

The left-hand valve 10 illustrated in FIG. 5 of the drawing is shown in its upwardly displaced position, inasmuch as no workpiece 2 is situated underneath the associated suction aperture 7. All other valves 10 are in their open positions, that is, they are dropped down and let the suction force pass therethrough, inasmuch as a workpiece 2 covers the associated suction apertures 7.

In the basic principle, this means that, when the flow=0, then the valves 10 are in their lower open positions and the vacuum is effective. When a flow=X comes into being, then the valves 10 are situated in their upper closed positions and no vacuum is effective under these circumstances at the affected region.

Flow=0 means that a workpiece 2 is present at the region of the suction openings 7 and no crack is present in the workpiece 2 at this region. Flow=X means that no workpiece 2 is located at the region of the suction openings 7 or that a crack is present in the workpiece 2 at this region. In total pressure equalization, the valves 10 drop downwardly due to their own weights and are ready for permitting the passage of the suction force therethrough.

For the deposition of the workpieces 2, the three-way valve 23 is switched into its other position, so that ambient air at atmospheric pressure is enabled to flow into the suction chamber 3 through the aereating nozzles 23, and in this manner, the vacuum is eliminated.

The above-described apparatus can be suspended on suspension arrangements or guides for movement in the vertical and horizontal directions and can be used alone by itself for the lifting and transporting of workpieces 2.

Figure 2:
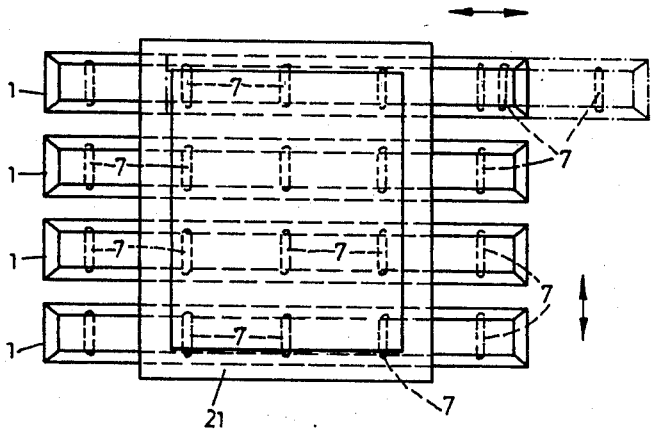
FIG. 2 is a diagrammatic top plan view of the lifting arrangements held underneath the vacuum accumulator.

Inasmuch as this vacuum lifting apparatus is so constructed as to be relatively narrow but commensurately long, it is advantageous to arrange a plurality of such lifting apparatuses at a distance from each other and next to one another underneath a box-shaped or frame-shaped vacuum accumulator 21 for positional adjustment in the longitudinal and transverse direction, as indicated in FIGS. 1 and 2 of the drawing. Herein, the three-way valve 23 and the hose conduit 20 are disposed at one longitudinal end region of the housing 1 and each of the lifting apparatuses is provided with and connected with the vacuum accumulator 21 by means of its own valve 23 and its own hose conduit 20.

The longitudinal and transverse displacement of the lifting apparatuses is achieved by means of suitable guides and arresting means arranged underneath the vacuum accumulator 21. As a result of this positionally adjustable arrangement of a plurality of the lifting apparatuses underneath a single shared vacuum accumulator 21, it is possible to achieve a variable positional adjustment of the suction openings 7 with respect to one another and, as a result of this, the suction surface is more variable than heretofore possible with respect to its engagement locations (suction apertures 7) and is adjustable to all possible shapes of the workpieces 2 to be handled. In this manner, various grids and suction centers can be adjusted.

In FIG. 1, the reference numeral 25 has been used to denote tubular support elements 25 for the vacuum accumulator 21 which is equipped with a plurality of lifting apparatuses to constitute a lifting installation (arrangement), the support elements 25 serving for moving the lifting arrangement vertically and horizontally.

While the present invention has been described and illustrated herein as embodied in a specific construction of a vacuum lifting arrangement, it is not limited to the details of this particular construction, since various modifications and structural changes are possible and contemplated by the present invention. Thus, the scope of the present invention will be determined exclusively by the appended claims.

What is claimed is:

1. A vacuum lifting arrangement for flat workpieces, such as wood beams and the like, comprising a movable housing bounding a suction chamber having a downwardly open suction side;

a valve insert accommodated in said suction chamber;

a closing plate hingedly mounted on said housing for pivoting into an out of a closing position in which it sealingly covers said downwardly open suction side of said suction chamber and said valve insert; and an elastic sealing element in the form of a foamed mat having suction apertures, mounted on said closing plate, and operative for sealingly contacting the workpieces to be lifted.

2. The vacuum lifting arrangement as defined in claim 1, wherein said housing has a hood-shaped configuration having an elongated rectangular basic shape and a trapezoidal cross section having a large base side situated downwardly and being open; and wherein said base side is closed by said closing plate and said elastic sealing element mounted thereon.

3. The vacuum lifting arrangement as defined in claim 2, wherein said housing has two marginal flanges and said closing plate has two longitudinal edge portions; and further comprising hinge means for pivotally mounting one of said longitudinal edge portions on one of said marginal flanges, and at least two connecting means for releasably connecting the other of said longitudinal edge portions under tension to the other of said marginal flanges.

4. The vacuum lifting arrangement as defined in claim 3, wherein each of said connecting means includes one of threaded connecting means, buckle connecting means, and bayonet connecting means.

5. The vacuum lifting arrangement as defined in claim 3, wherein each of said connecting means includes threaded connecting means including a threaded bolt pivotally mounted on said closing plate and passing through an opening of said other marginal flange in a connecting position thereof, and a threaded hand nut threaded onto said threaded bolt and operative for arresting the same in said connecting position thereof.

6. The vacuum lifting arrangement as defined in claim 5, wherein said opening is bore-shaped.

7. The vacuum lifting arrangement as defined in claim 5, wherein said opening is slot-shaped.

8. The vacuum lifting arrangement as defined in claim 3, wherein said hinge means includes at least one rod hinge.

9. The vacuum lifting arrangement as defined in claim 8, wherein said hinge means includes a hinge axle extending in the longitudinal direction of said housing and extractable from the remainder of said hinge means for removal of said closing plate with said sealing element from said housing.

10. The vacuum lifting arrangement as defined in claim 1, and further comprising circumferentially extending sealing means secured to the lower sides of said housing and of said valve insert and sealingly engaged under tension by said closing plate.

11. The vacuum lifting arrangement as defined in claim 1, wherein said valve insert includes a hollow casing extending over the entire length of said housing and including internal partitioning walls that subdivide the interior of said casing into a plurlaity of individual chambers, and a plurality of valves each arranged in one of said individual chambers.

12. The lifting arrangemetn as defined in claim 11, wherein each of said valves is one of a tappet valve, dish valve, ball valve, jet nozzle and the like.

13. The lifting arrangement as defined in claim 11, wherein each of said valves is mounted in an upper wall of said valve insert for vertical movement, and wherein each of said individual chambers opens at a lower region thereof onto said closing plate by a large-area opening.

14. The lifting arrangement as defined in claim 11, wherein said valve insert is removably mounted in said housing.

15. The lifting arrangement as defined in claim 14, wherein said valve insert has two oppositely situated sides and includes at least two outwardly extending connecting lugs at each of said sides thereof, and said housing includes inwardly extending connecting webs; and further comprising connecting screws which extend through said connecting lugs and said connecting webs and serve for releasably mounting said valve insert in said housing.

16. The lifting arrangement as defined in claim 11, wherein said valve insert is accommodated in said suction chamber with a clearance at all sides from said housing; and further comprising a vacuum accumulator, means including a three-way valve and a hose conduit for connecting said vacuum accumulator with said suction chamber, and a vacuum pump connected to said vacuum accumulator.

17. The lifting arrangement as defined in claim 16, wherein said housing includes a nipple which is arranged at one longitudinal end of said housing and bounds a suction opening; and wherein said three-way valve is accommodated in said suction opening and is switchable between a suction position and an aerating position thereof.

18. The lifting arrangement as defined in claim 1, further comprising a plurality of additional housings, valve inserts, closing plates and sealing elements similar to said housing, valve insert, closing plate and sealing element, respectively and a vacuum accumulator, all of said housings being mounted underneath said vacuum accumulator for individual stepless vertical and horizontal movement and for arresting in position to form a vacuum lifting installation which is adjustable with respect to a distribution of suction openings.

19. The lifting arrangement as defined in claim 18, wherein said vacuum accumulator is configured as a housing or frame which is closed at all sides and holds all of said housings on respective guides.

20. The lifting arrangement as defined in claim 1, wherein said valve insert includes a hollow casing extending over the entire length of said housing and including internal partitioning walls that subdivide the interior of said casing into a plurality of individual chambers, and a plurality of valves each arranged in one of said individual chambers; and wherein said closing plate is provided with a suction opening at a region of each of said individual chambers of said valve insert, and said sealing element is provided at a region of each of said suction openings with a suction aperture having an elongated slot-shaped configuration extending transversely to the longitudinal direction of said housing.

* * * * *